US006339892B1

(12) United States Patent
Ramos

(10) Patent No.: US 6,339,892 B1
(45) Date of Patent: Jan. 22, 2002

(54) TRIGGER LOCKING MECHANISM WITH SLIDABLE PLATE

(76) Inventor: Israel Ramos, 2309 NW. 7 St., Miami, FL (US) 33125

( * ) Notice: Subject to any disclaimer, the term of this patent is extended or adjusted under 35 U.S.C. 154(b) by 0 days.

(21) Appl. No.: 09/631,733

(22) Filed: Aug. 4, 2000

(51) Int. Cl.[7] ..... F41A 17/00
(52) U.S. Cl. ..... 42/70.07; 42/70.06
(58) Field of Search ..... 42/70.06, 70.07

(56) References Cited

U.S. PATENT DOCUMENTS 1,686,482 A * 10/1928 Windle
2,590,516 A 3/1952 de von Breymann ..... 42/70
3,020,663 A * 2/1962 Newson
3,022,596 A * 2/1962 Cannon
3,064,383 A * 11/1962 Newson
3,066,433 A * 12/1962 Rogers et al.
5,899,102 A * 5/1999 Ling
6,154,995 A * 12/2000 Lenoir et al.
6,260,299 B1 * 7/2001 Jordan
6,272,784 B1 * 8/2001 Ringers

FOREIGN PATENT DOCUMENTS

FR 1134406 * 12/1956

* cited by examiner

*Primary Examiner*—Michael J. Carone
*Assistant Examiner*—Troy Chambers
(74) *Attorney, Agent, or Firm*—J. Sanchelima; A. Boroas

(57) ABSTRACT

A safety locking mechanism for weapons that have a trigger and a protective trigger guard. The mechanism includes a housing defining an internal space and a lateral opening through which a slidable spring biased plate protrudes and is brought out in a parallel and space apart relationship with another plate that is rigidly mounted to the housing. A headed post and a separated and removable body member are mounted to the fixed plate and receive the trigger inbetween. The body member conforms to the space between the rear of the trigger and the guard thereby immobilizing it. A locking assembly inside the housing is selectively actuated to release a latch that holds slidable plate inside. The slidable plate and the rigid plate sandwich a trigger and trigger guard to prevent access thereto.

4 Claims, 2 Drawing Sheets

TRIGGER LOCKING MECHANISM WITH SLIDABLE PLATE

BACKGROUND OF THE INVENTION

1. Field of the Invention.

The present invention relates to a weapon's trigger locking mechanism, and more particularly, to the type that prevents access to the trigger area.

2. Description of the Related Art.

Many designs for trigger locking mechanisms have been designed in the past. None of them, however, include a slidable plate that prevents access to the trigger area preventing its activation. The present invention provides a device for readily and effectively preventing the unauthorized use of a weapon. Additionally, it can be installed on a variety of weapons with different configurations for the trigger area.

Applicant believes that the closest reference corresponds to U.S. Pat. No. 2,590,516 issued to Maruja Acosta de von Breymann in 1952 for a trigger safety for firearms. Breymann's patent provides a safety device for a trigger that covers the guard and trigger area. However, it differs from the present invention because the Breymann's patent presents separately a locking mechanism and a guard as different form of safety mechanisms. Breymann's patent does not disclose a slidable plate in the locking mechanism and it requires the use of a block requiring a high degree of custom work.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a safety locking mechanism for a weapon's trigger that prevents access to the trigger area preventing its activation.

It is another object of this invention to provide a locking mechanism that can be readily mounted and unmounted from a weapon.

It is still another object of the present invention to provide a locking mechanism that is adaptable to weapons with different configurations of the trigger area.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
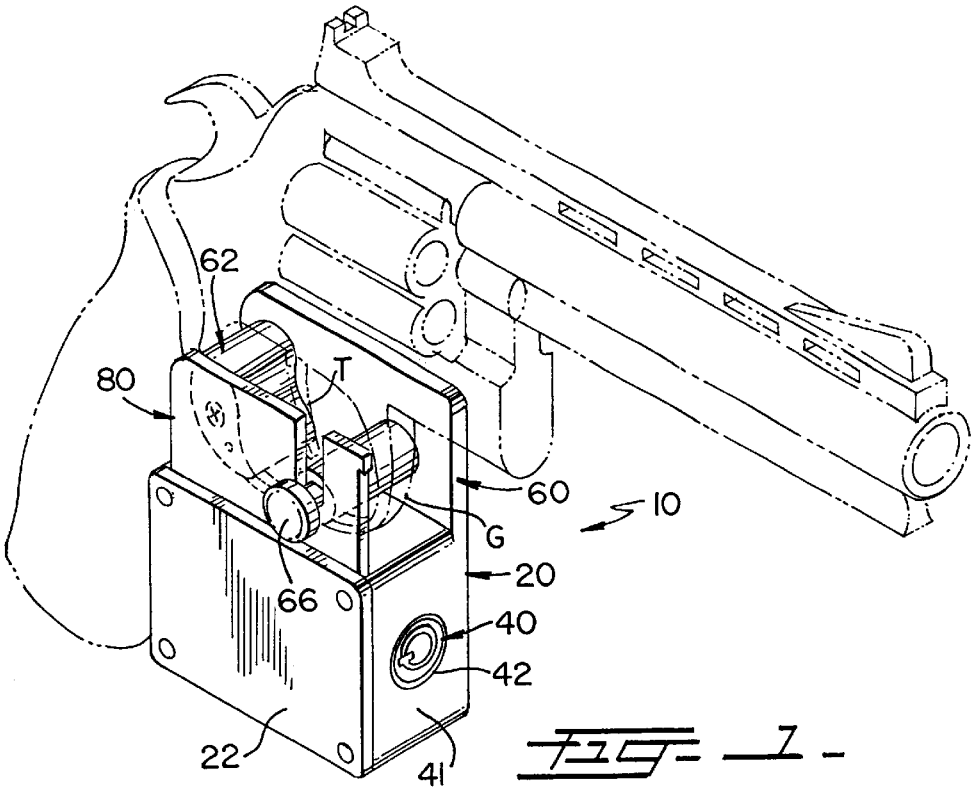
FIG. 1 is an isometric view of the present invention showing the secured weapon in phantom.
Figure 2:
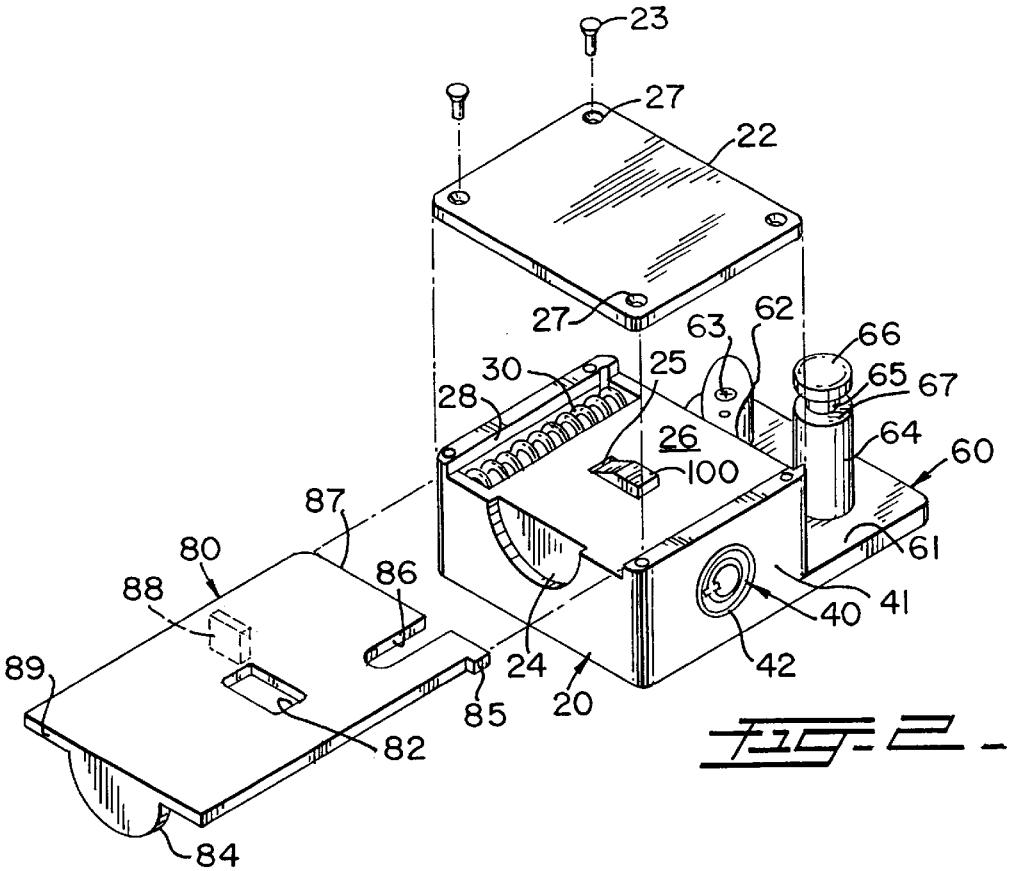
FIG. 2 is a representation of an isometric view of the invention with cover removed so that the internal components can be seen.
Figure 3:
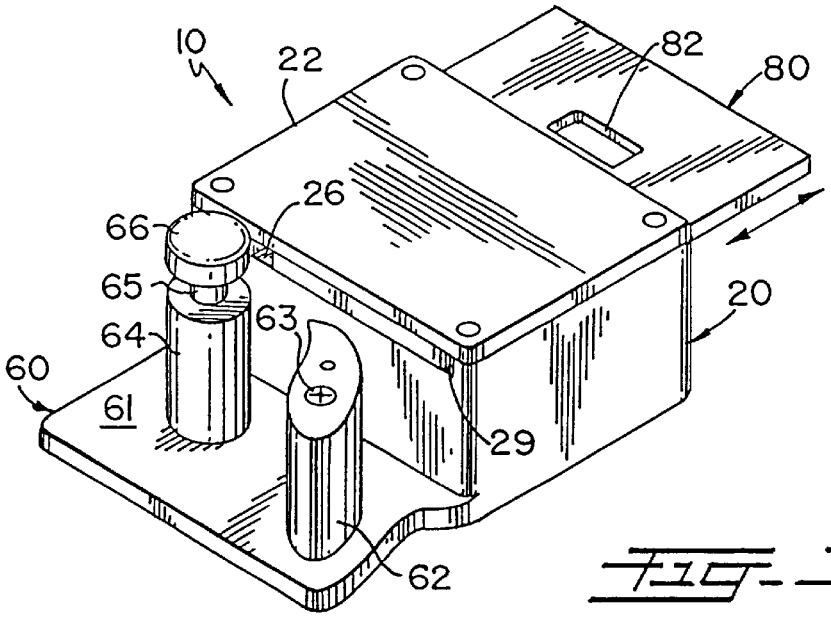
FIG. 3 shows an isometric view of the present invention from one end, with the slidable plate in fully retracted position.

Referring now to the drawings, where the present invention is generally referred to with numeral 10, it can be observed that it basically includes housing 20 containing locking assembly 40 (actuated by key K), fixed plate assembly 60 rigidly mounted to and extending from one end of housing 20. Connecting opening 42 in side wall 41 exposes the key hole of locking assembly 40 to receive key K. Slidable plate 80 is retractable within housing 20 and adapted to protrude out in a parallel and spaced apart relationship with respect to fixed plate assembly 60. Cover 22 is mounted to housing 20 with rivets 23 passing through openings 27. The resulting structure is volumetrically efficient and an effective security device.

Figure 4:
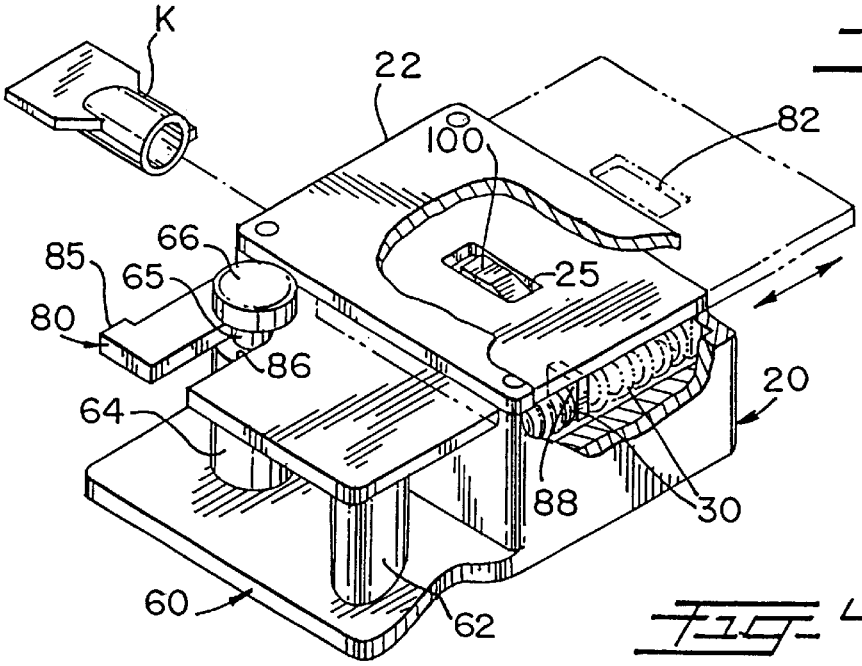
FIG. 4 illustrates an isometric view of the device shown in the previous figure, from the opposite end, and with the slidable plate fully distended.

The separation between distended slidable plate 80 and fixed plate assembly 60 is such that trigger guard G is received inbetween. In this manner, trigger T and its surrounding area can not be accessed, either intentionally or by accident. Plate 80 is spring loaded urging it to protrude out of housing 20. A user can then, after unlocking mechanism 10, push plate 80 in until locking pin 100 is lodged inside openings 25 and 82 locking it in place, as best seen in FIG. 4. Wall 26 is positioned parallel to cover 22 and spaced apart therefrom defining a lateral opening 29. Cut out 28 of wall 26 permits finger member 88 to engage spring 30. Member 88 is rigidly and perpendicularly mounted to the underside of slidable plate 80. When plate 80 slides inwardly, finger member 88 coacts with spring 30 compressing the latter.

Figure 5:
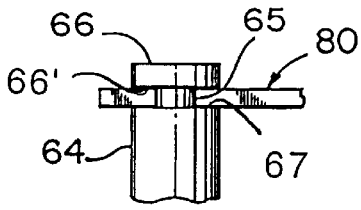
FIG. 5 show a front elevational view of the headed post when slidable plate (shown partially) is fully distended.

Fixed plate assembly 60 includes headed post 64 and removable curved body 62 mounted on surface 61. In the preferred embodiment screw 63 is used to keep body 62 removably mounted to plate assembly 60. When plate 80 slides out, slot 86 receives shank 65 of headed post 64. Head 66 is above slot 86 when plate 80 is fully distended. The underside 66' of head 66 and recess 67 sandwich the edge defining slot 86 to minimize movement of the distended plate 80, as best seen in FIG. 5. Removable curved body 62 is cooperatively mounted on surface 61 at a sufficient distance to coact with trigger T immobilizing it. Curved body 62 is removable and it has a cooperative configuration for the design of the weapon being protected. Thus, body 62 and post 64 coacting with guard G immobilize device 10.

Slidable plate 80 also includes stopper leg 85 on one end 87 that prevents the former from sliding out completely when retracted. The other end 89 has a tab 84, in the preferred embodiment, extending preferably perpendicularly thereto and it is used to provide a surface to push slidable plate 80. Tab 84 is cooperatively received by slot 24 when sidable plate 80 is fully distended.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A safety locking mechanism for weapons having a trigger with a protective guard, comprising:

A) a housing defining an internal space, having first and second openings connecting said internal space to the exterior;

B) locking means mounted in said internal space and including an actuating key partially insertable through said first opening, said locking means further including a locking pin movable between two predetermined positions;

C) a fixed plate having first and second surfaces mounted to said housing and extending therefrom a predetermined distance, said fixed plate includes a headed post and a body member mounted perpendicularly on said first surface with predetermined separation to receive the trigger of a weapon inbetween and said body member having cooperative dimensions to substantially occupy the space between the trigger and the protective guard of a weapon; and D) a slidable plate having first and second ends and being retractable within said housing and protruding through said second opening, said slidable plate being releasably engaged by said locking pin, and said slidable plate extending in a plane that is kept at a parallel and spaced apart relationship with respect to said fixed plate, and said first end including a slot for cooperatively receiving said headed post.

2. The mechanism set forth in claim 1 wherein said curved body substantially conforms to the configuration of a weapon's trigger to immobilize the latter in combination with said headed post.

3. The mechanism set forth in claim 2 wherein said housing includes spring means for biasing said slidable plate urging the latter to distend out of said housing.

4. The mechanism set forth in claim 3 wherein said first end includes a leg that prevents said slidable plate from sliding completely out of said housing.

* * * * *